US006123480A

United States Patent [19]

Petty et al.

[11] Patent Number: 6,123,480

[45] Date of Patent: Sep. 26, 2000

[54] ANTI-WRAP DEVICE FOR SWING SET

[75] Inventors: Keith Petty, Farmington, Mo.; Michael Francis Vercell, Formby, United Kingdom

[73] Assignee: Little Tikes Commerical Play Systems, Inc., Farmington, Mo.

[21] Appl. No.: 08/874,653

[22] Filed: Jun. 13, 1997

[51] Int. Cl.[7] ..... F16B 1/00; A63G 9/00

[52] U.S. Cl. ..... 403/164; 403/71; 403/78; 403/26; 472/118

[58] Field of Search ..... 403/164, 362, 403/71, 78, 26, 157, 150, 119; 384/280, 276, 295, 416; 472/118, 119; 474/166

[56] References Cited

U.S. PATENT DOCUMENTS

| | | | |
|---|---|---|---|
| 1,756,413 | 4/1930 | Wilke et al. . | |
| 2,474,718 | 6/1949 | Bender | 155/58 |
| 2,584,757 | 2/1952 | Stroh | 248/341 |
| 2,728,617 | 12/1955 | Edwards | 308/189 |
| 2,789,871 | 4/1957 | White | 308/189 |
| 2,900,160 | 8/1959 | Hammond | 248/341 |
| 3,010,733 | 11/1961 | Melton et al. | 403/164 X |
| 3,014,683 | 12/1961 | Littmann | 248/214 |
| 3,411,774 | 11/1968 | Thornton | 472/118 X |
| 3,891,287 | 6/1975 | Vogt | 384/280 |
| 4,036,489 | 7/1977 | Potyondy | 472/118 X |
| 4,094,503 | 6/1978 | Wormser | 272/85 |
| 4,138,104 | 2/1979 | D'Amicis | 272/85 |
| 4,717,268 | 1/1988 | Orkin | 384/280 |
| 4,889,435 | 12/1989 | Gojon | 384/276 |
| 4,930,910 | 6/1990 | Mori et al. | 384/276 |
| 5,147,247 | 9/1992 | Addleman | 472/118 |
| 5,197,926 | 3/1993 | Cunard | 472/118 |
| 5,398,294 | 3/1995 | Narkon | 384/295 X |
| 5,529,539 | 6/1996 | Hoffman | 472/118 |
| 5,716,056 | 2/1998 | Bokram | 403/364 X |

OTHER PUBLICATIONS

Wicksteed Leisure, United Kingdom, "Swings" advertisement, 1 page, (Mar. 1997).

*Primary Examiner*—Lynne H. Browne
*Assistant Examiner*—John R. Cottingham
*Attorney, Agent, or Firm*—Renner, Kenner, Greive, Bobak, Taylor & Weber

[57] ABSTRACT

A device (10) for preventing a swing from being wrapped over a crossbar (18) of a swing set includes a base (12) and a sleeve (14) rotatably carried by the base (12). The base (12) includes a pair of collars (20) that each have a seat portion (22) bounded by a shoulder (26) at one edge. The collars (20) are attached to the crossbar (18) so that the seat portions (22) abut and cooperate to form a seat (42) that is bounded by the shoulders (26). The sleeve (14) rides on the seat (42) between the shoulders (26). The sleeve (14) is non-concentric and includes a tab (60) that angularly extends radially outwardly from the sleeve (14). The tab (60) has a hole (62) that accepts a bolt (64) that connects a chain (16) of the swing to the device (10).

16 Claims, 7 Drawing Sheets

ANTI-WRAP DEVICE FOR SWING SET

TECHNICAL FIELD

This invention is related to outdoor playground equipment in general and, in particular, to a device for a swing set that prevents a swing from being wrapped over the upper crossbar of the swing set. More specifically, the device includes a base that rotatably carries a sleeve that carries a swing chain such that when the swing is thrown over the upper crossbar, the sleeve rotates with the swing to prevent the chain from wrapping around the crossbar.

BACKGROUND ART

One problem with playground swings is that children often throw the swings over the upper crossbar of the swing set so that the swings may ultimately become wrapped around the crossbar. Wrapped swings are typically unusable and must be unwrapped by maintenance personnel. Even when the swing is evenly wrapped around a crossbar such that it appears to be useable, use of a wrapped swing may damage the crossbar or the chains that support the swing seat, or could prove dangerous to the user. Unwrapping swings consumes the time of maintenance personnel and is thus expensive. It is thus desirable to provide a device that prevents the swings from being wrapped over the crossbar.

One device known in the art for preventing swing wrapping is disclosed in U.S. Pat. No. 5,147,247. This patent discloses a barrier assembly for swings that is mounted on top of the crossbar of the swing set. The barrier is configured to prevent a swing from passing over the crossbar and becoming wrapped. Although functional, this device requires a considerable amount of material and must be configured differently for different sized swing sets.

Another device known in the art for preventing swing wrapping includes a pair of clevises that are each supported from a clevis housing. The clevis housings are spaced by an outer bar that slides over the upper crossbar of a swing set. Each clevis housing rotates on a set of ball bearings such that the devises and the outer bar rotate together as a unit. Although this device is useful for preventing swing wrapping, it is rather expensive to manufacture due to the ball bearings and the machining required to create the individual parts. Furthermore, the distance between the clevises cannot be easily adjusted because the distance is permanently set by the outer bar. The device is also relatively heavy.

When designing outdoor playground equipment, numerous safety standards must be met before the equipment may be installed and used on a playground. One of these standards limits the size and type of protrusions that may be present on the equipment. A protrusion is generally something that extends outwardly from the equipment and presents an area where loose articles of clothing or other items may be snagged. One common device that creates a protrusion is a nut and bolt combination. A bolt necessarily must protrude through a surface so that a nut may be screwed onto the threaded end of a bolt. However, the protruding nut and bolt end create a safety hazard in the nature of a protrusion. Thus, it is desirable that any device that is used to prevent swing wrapping accomplish its purpose without creating protrusions as defined by the ASTM's Standards for Playground Equipment.

DISCLOSURE OF THE INVENTION

In view of the foregoing, it is an object of the present invention to provide a device that is installed in combination with an identical device to support a swing from a crossbar of a swing set and that prevents the swing from being wrapped over the cross bar.

It is another object of the present invention to provide an anti-wrap device for a swing set, as above, that is installed in pairs with each device supporting one of the swing's chains, the devices being mounted on the crossbar of the swing set such that the distance between the devices may be adjusted.

It is an additional object of the present invention to provide an anti-wrap device for a swing set, as above, that uses metal to plastic contact instead of using ball bearings.

It is yet another object of the present invention to provide an anti-wrap device for a swing set, as above, that utilizes a non-concentric sleeve that returns to a predictable position due to the force of gravity.

It is a further object of the present invention to provide an anti-wrap device for a swing set, as above, that includes a tab that protrudes from the sleeve such that the non-concentricity of the sleeve positions the tab downwardly while at rest.

It is a still further object of the present invention to provide an anti-wrap device for a swing set, as above, that includes an angled tab that aligns the center line of a chain of a swing with the center of the anti-wrap device.

It is a further object of the present invention to provide an anti-wrap device for a swing set, as above, that includes an angled tab that effectively removes a protrusion from the device as defined by ASTM safety standards.

It is an additional object of the present invention to provide an anti-wrap device for a swing set, as above, that may be easily retrofit onto existing swing sets without the requirement of disassembling the swing set.

These and other objects of the present invention, which will become apparent from the description to follow, are accomplished by the improvements hereinafter described and claimed.

In general, in accordance with one aspect of the present invention, a device for preventing a swing from being wrapped over the crossbar of a swing set includes a base defining a seat. The base has a longitudinal opening configured such that the base may fit on the crossbar. A sleeve is rotatably carried by the base in the seat, the swing being connected to the sleeve.

In accordance with another object of the present invention, the base and the sleeve are divided into joinable halves such that the base may be fit onto the crossbar and the sleeve may be fit onto the base.

A preferred anti-wrap device for a swing set incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
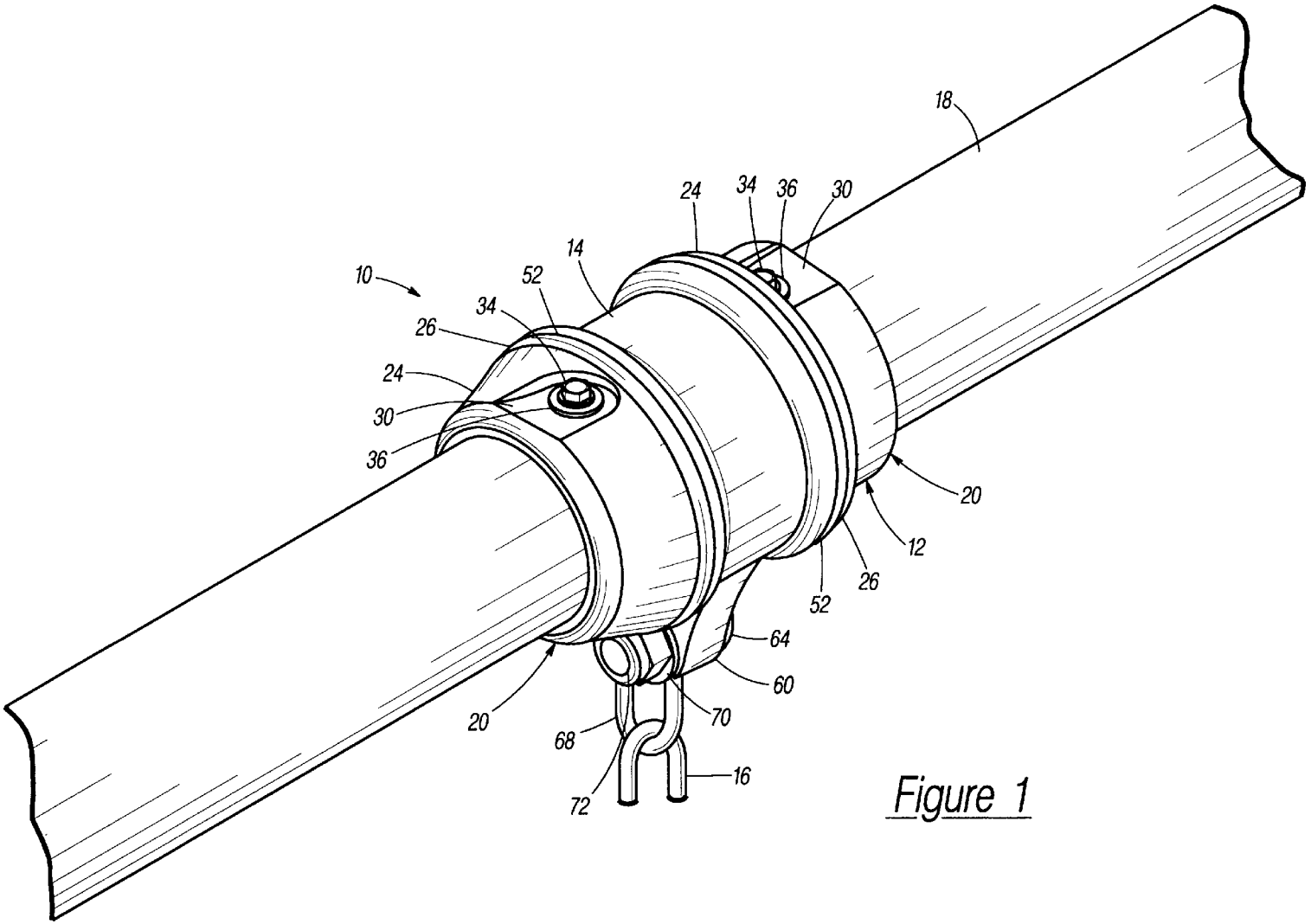
FIG. 1 is a fragmented perspective view of a crossbar of a swing set having anti-wrap devices made in accordance with the concepts of the present invention, only one device being depicted supporting a single chain.
Figure 2:
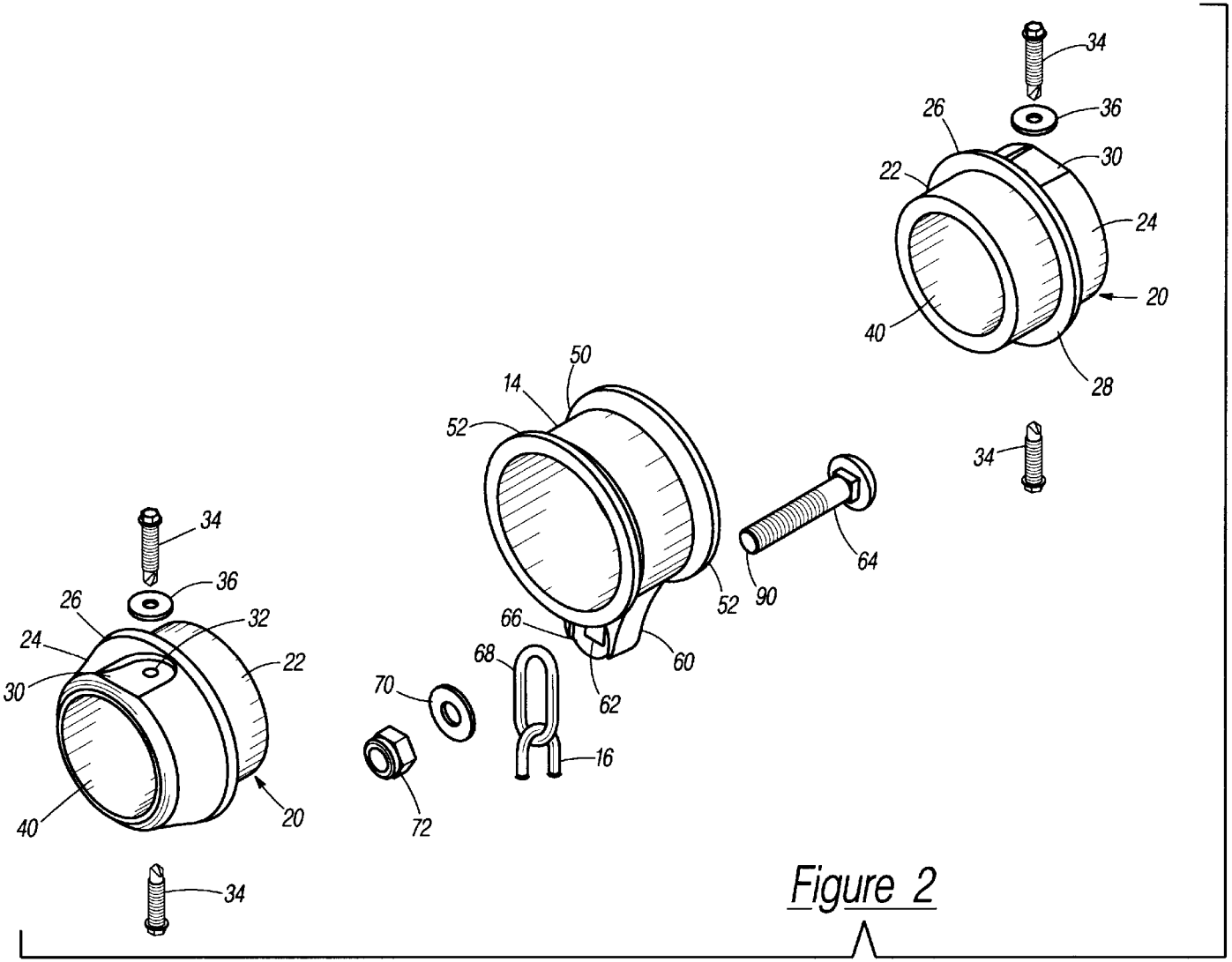
FIG. 2 is an exploded perspective view of one device.
Figure 3:
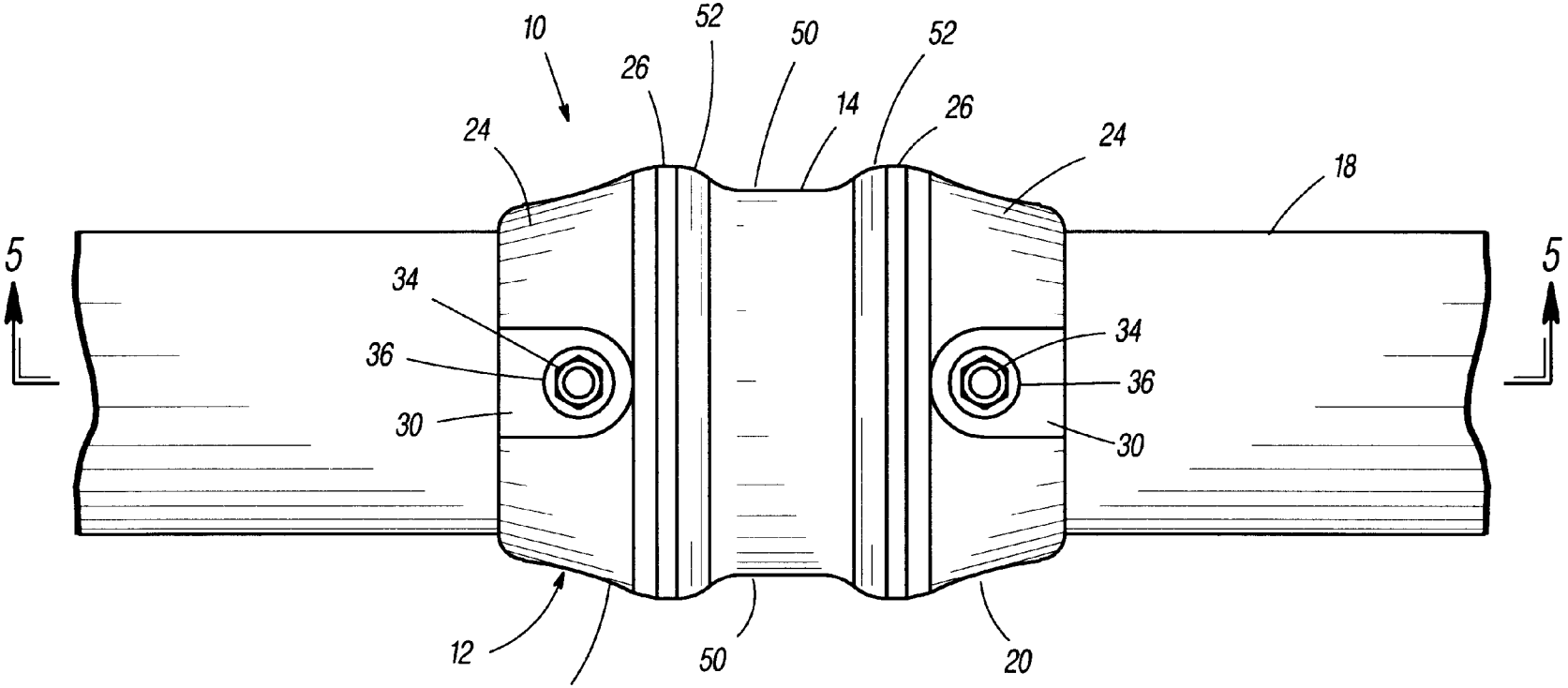
FIG. 3 is a top plan view of one device installed on the crossbar of a swing set.
Figure 4:
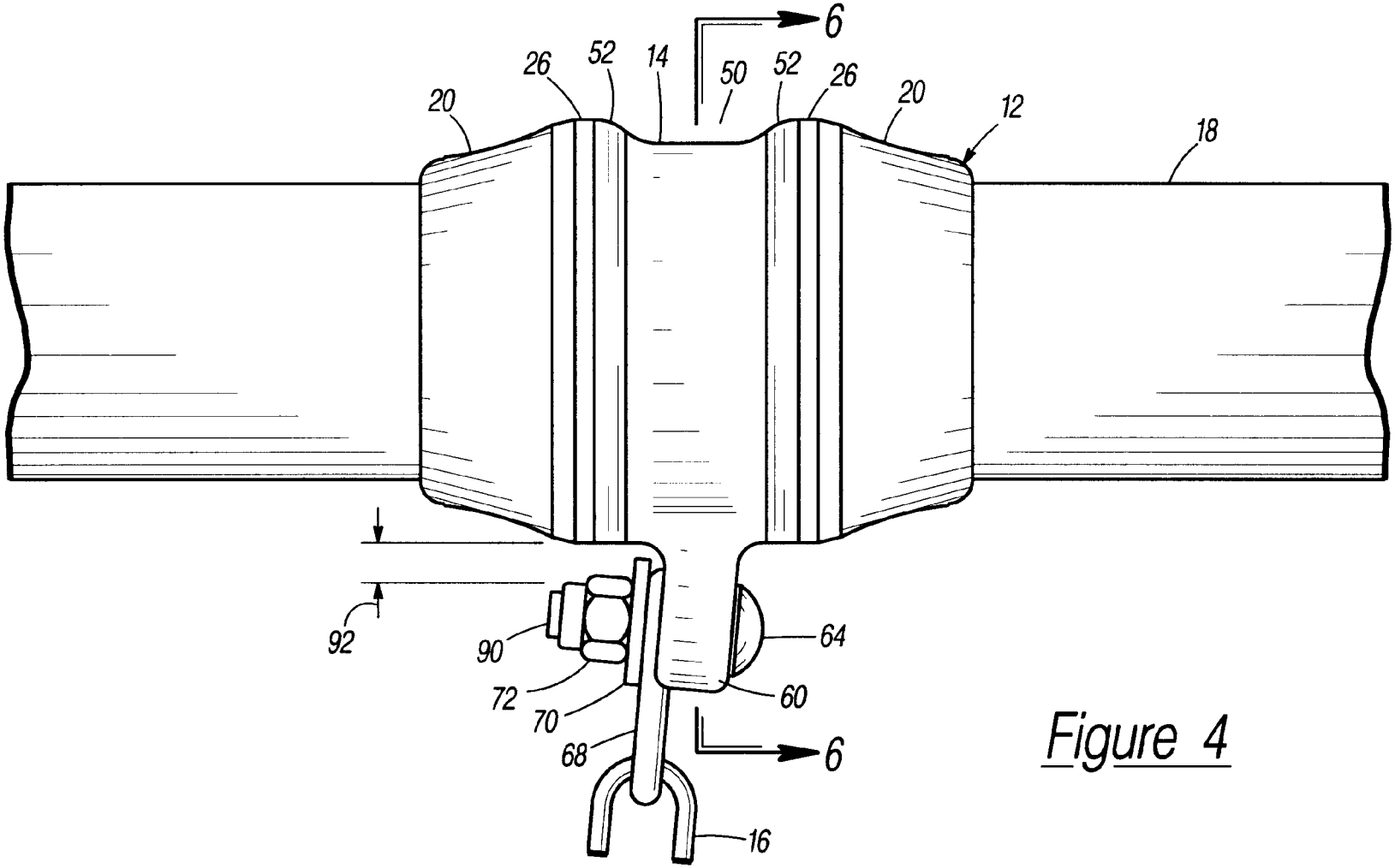
FIG. 4 is a front elevational view of one device installed on the crossbar of a swing set.
Figure 5:
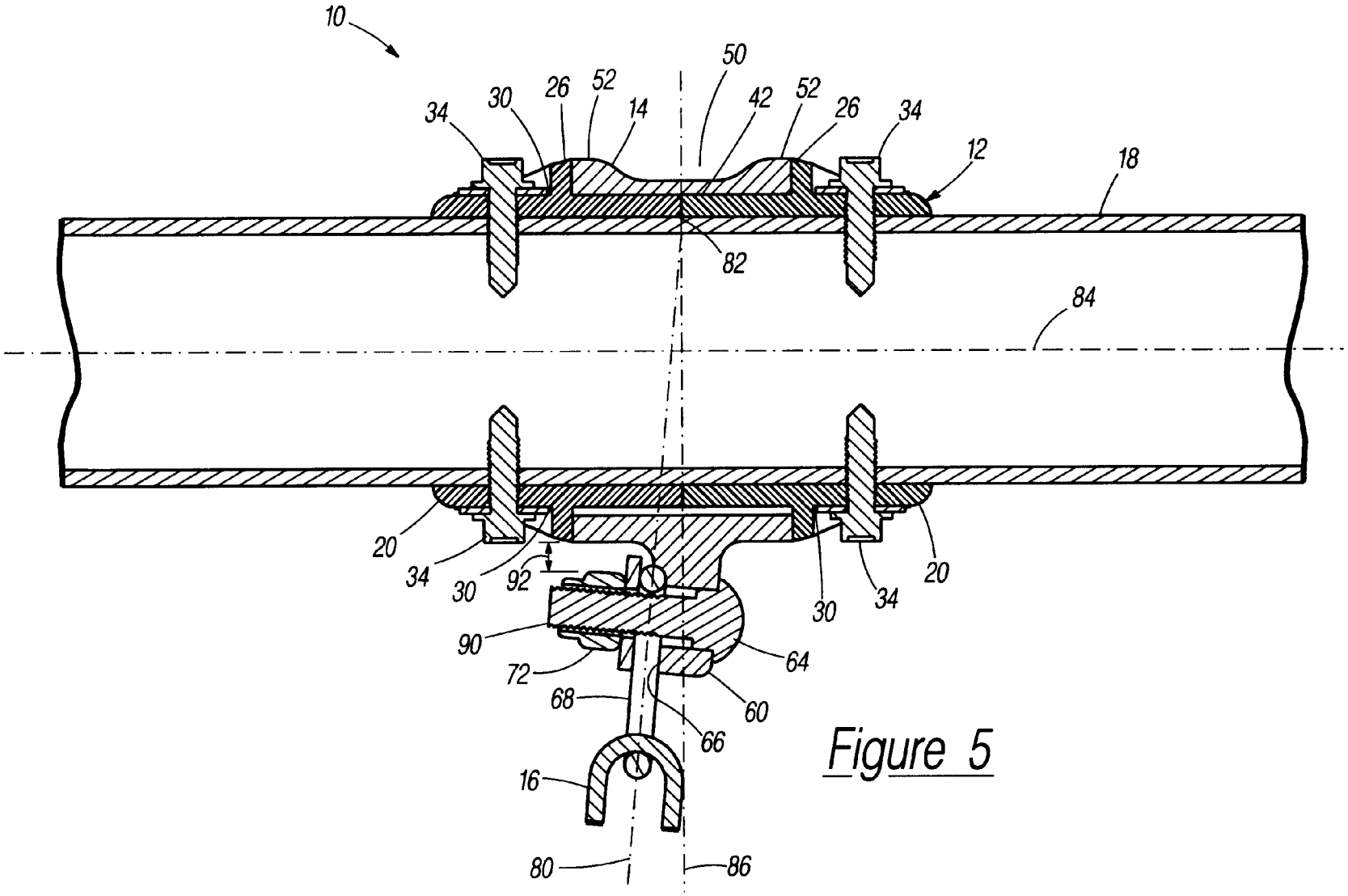
FIG. 5 is a sectional view of one device taken substantially along line 5—5 of FIG. 3.
Figure 6:
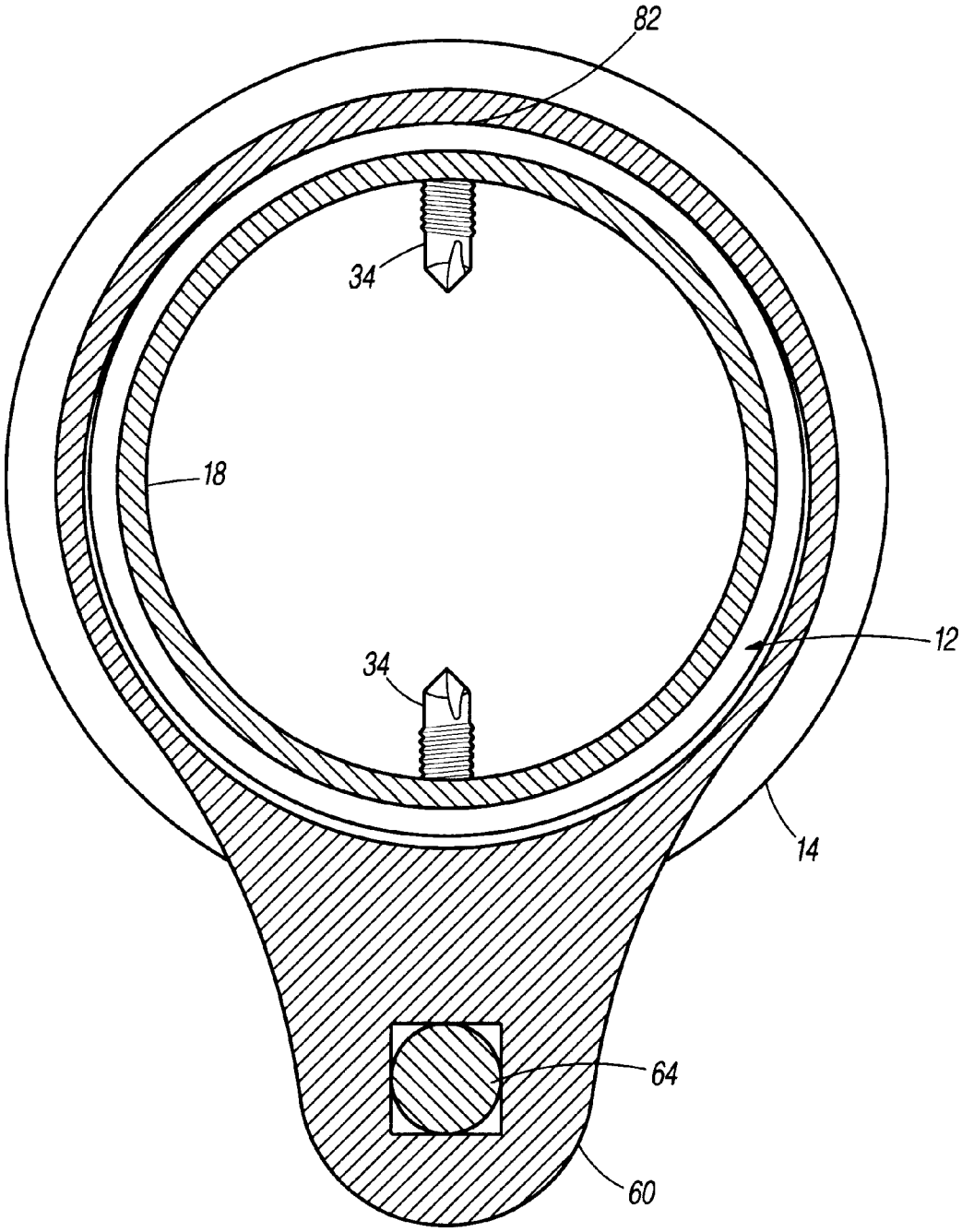
FIG. 6 is a sectional view of one device taken substantially along line 6—6 of FIG. 4.

A device for preventing a swing from being wrapped over the crossbar of a swing set is indicated generally by the numeral 10 in the accompanying drawings. Although device 10 must be installed in pairs to support a typical swing, only one device 10 is described in detail, it being understood that two substantially identical devices are used to support a swing. Device 10 generally includes a base 12 that rotatably carries a sleeve 14. A swing for a typical swing set generally includes a swing seat (not shown) that is supported by a pair of ropes or chains 16 (only one chain shown). Device 10 is installed in pairs on a crossbar 18 of a swing set. Each device 10 is connected to one of the chains 16 of the swing such that the swing is supported from crossbar 18. Devices 10 are independent such that the distance between devices 10 on crossbar 18 may be easily adjusted to accommodate swings having various-sized swing seats. It is generally desirable to space the connections between chains 16 and crossbar 18 at a distance somewhat greater than the width of the swing seat such that chains 16 are angularly disposed with respect to crossbar 18 instead of being perpendicularly disposed. As such, different swing seats require different distances between devices 10. When a swing is supported by a pair of devices 10, the swing may not be wrapped over crossbar 18 because sleeve 14 rotates with the swing when the swing is thrown over crossbar 18.

Base 12 includes a pair of substantially identical, interchangeable collars 20 that each have a seat portion 22 and a body portion 24. A shoulder 26 extends upwardly from one edge of seat portion 22 to define a substantially outwardly extending, vertical wall 28 at one edge of seat portion 22. On the other side of shoulder 26, body portion 24 extends angularly downwardly back toward crossbar 18. Body portion 24 includes a notch that surrounds an aperture 32 that receives a screw 34 to secure collar 20 to crossbar 18. In the embodiment of the invention depicted in the drawings, two screws 34 are used with each collar 20. In addition, it is desirable to provide a washer 36 between each screw 34 and collar 20 so that the force of screw 34 may be spread over notch 30. Notch 30 is thus configured to receive washer 36.

Each collar 20 is generally tubular having a longitudinal bore 40 therethrough that is configured to be snugly received on crossbar 18. Collars 20 are installed on crossbar 18 such that seat portions 22 abut to form a single seat 42 internally of sleeve 14 on which sleeve 14 rotates. Sleeve 14 is carried by base 12 on seat 42 such that sleeve 14 is bounded by shoulders 26 of collars 20. As such, sleeve 14 cannot move longitudinally along crossbar 18 but may only rotate with respect to base 12. This configuration causes sleeve 14 to rotate directly against base 12 without the use of ball bearings or roller bearings. It is desirable that base 12 be fabricated from plastic such that the overall cost of manufacturing device 10 is relatively inexpensive. Sleeve 14 may be, however, fabricated from metal to provide strength.

Sleeve 14 includes a channel 50 that extends partially about the circumference of sleeve 14. Channel 50 is positioned between a pair of shoulders 52 on sleeve 14 that abut shoulders 26 of base 12 when sleeve 14 is installed. Channel 50 also reduces the amount of material in sleeve 14 so that it is easier and less expensive to manufacture. Further, channel 50 does not extend completely about the circumference of sleeve 14 such that sleeve 14 is non-concentric. As such, sleeve 14 will return to a predictable position when at rest.

A tab 60 extends radially outwardly from sleeve 14 at the area where channel 50 does not extend about the circumference of sleeve 14. Tab 60 includes a through hole 62 that is configured to receive a bolt 64 that is used to connect chain 16 to device 10. Tab 60 includes a notch 66 that is configured to snugly receive a link 68 of chain 16. Chain 16 may be further connected to device 10 by a washer 70 and a lock nut 72.

Tab 60 is also angularly disposed to sleeve 14. The angular disposition of tab 60 is such that the center line 80 of chain 16 passes through the top, interior center point 82 of sleeve 14. This configuration reduces the amount of torque experienced by device 10 when a swing supported by a pair of devices 10 is being used. Top interior center point 82 of sleeve 14 is defined as the intersection of a plane 86 that is perpendicular to crossbar 18 and passes through the mid point of base 12 and a line perpendicular to plane 86 that is on the interior surface of sleeve 14 and is disposed 180 degrees from the center of tab 60.

The angular disposition of tab 60 also causes lock nut 72 and the end 90 of bolt 64 to be closer to base 12 and sleeve 14 than they would if tab 60 were perpendicular to sleeve 14. The distance indicated by the numeral 92 is reduced sufficiently such that a protrusion is not created by bolt end 90 and lock nut 72 as defined by the ASTM Safety Standards for Outdoor Playground Equipment. This configuration allows device 10 to pass such standards more easily than if it had a protrusion created by bolt end 90 and lock nut 72.

It can now be understood that a swing supported by a pair of devices 10 from crossbar 18 cannot be wrapped around crossbar 18. The swing cannot be wrapped because each chain 16 that supports the swing seat is connected to sleeve 14 that rotates freely relative to crossbar 18. Thus, when the swing is thrown over the crossbar 18, each chain 16 pulls sleeve 14 around crossbar 18 with the swing preventing chain 16 from being wrapped.

Figure 7:
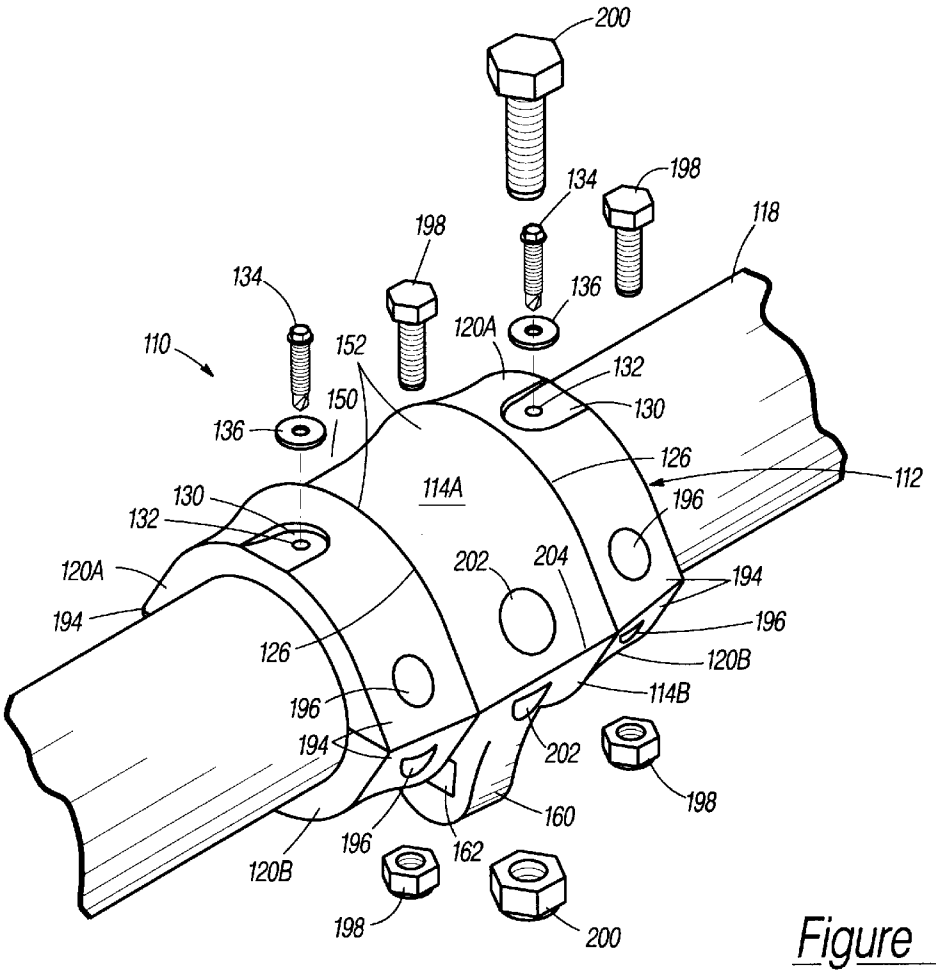
FIG. 7 is a fragmented, partially exploded perspective view of a crossbar of a swing set having an alternative embodiment of one anti-wrap device made in accordance with the concepts of the present invention.

Another embodiment of a device for preventing a swing from being wrapped over the upper crossbar of a swing set made in accordance with the concepts of the present invention is indicated generally by the numeral 110 in FIG. 7. The devices 110 are installed in pairs such that each device 110 supports a single chain (not shown) of a swing. Device 110 is substantially the same as device 10 described above and includes substantially the same elements as device 10. As such, device 110 generally includes a base 112 rotatably carrying sleeve halves 114A–114B. While device 10 is particularly suited to a swing seat which is being assembled, device 110 may be installed on a crossbar 118 of an existing, assembled swing set without requiring the swing set to be disassembled because device 110 is designed to be fit around crossbar 118 instead of slipped over the end of crossbar 118.

Device 110 may be fit around crossbar 118 because the collars 114 of base 112 and the sleeve 114 are split into halves 120A, 120B and 114A, 114B, respectively. Each collar half 120A, 120B may be joined together to form a collar that is substantially similar to collar 20 described above with respect to the first embodiment of the present invention. However, collar halves 120A, 120B have oppositely extending flanges 194 that define bolt holes 196. Each flange 194 and bolt hole 196 is configured to receive a nut and bolt combination 198. When installed on crossbar 118, nut and bolt combinations 198 function to clamp collar halves 120A, 120B to crossbar 118. Screws 134 may also be inserted into holes 132 to more securely attach base 112 to crossbar 118. Base 112 may also include notches 130, similar to notches 30 in the first embodiment of the present invention, that may received washers 136.

Once base 112 is installed, shoulders 126 and a seat (not shown) are formed that are substantially the same as shoulders 26 and seat 42 described above. The sleeve is then attached to base 112 by joining sleeve halves 114A and 114B about the seat of base 112 by suitable nut and bolt combinations 200. Nut and bolt combinations 200 extend through suitable bolt holes 202 that are present in flanges 204 that extend from each side of sleeve halves 114A, 114B. Sleeve halves 114A, 114B provide a channel 150 similar to channel 50 described above that defines a pair of shoulders 152 on sleeve halves 114A, 114B that abut shoulders 126 of base 112.

A tab 160 extends angularly outwardly from sleeve halves 114A, 114B at the same angle described above with respect to the first embodiment of the present invention. Sleeve 160 defines a bolt hole 162 that is configured to receive a bolt (not shown) that attaches a chain (not shown) to tab 160.

Thus, it now can be understood that device 110 may be installed over an existing crossbar 118 without the need to telescope device 110 over the end of crossbar 118. Once installed, device 110 may be used to support a swing chain such that the swing will not wrap over crossbar 118 when thrown over crossbar 118 because sleeve halves 114A, 114B rotate relative to crossbar 118 along with the swing. It is also desirable to configure bolt holes 196, 202 and flanges 194, 204 such that nut and bolt assemblies 198, 200 do not protrude from device 110 to form undesirable protrusion as defined by ASTM Safety Standards.

Devices 10 and 110 may be installed on crossbars 18 having cross sections other than the round cross section depicted in the drawings. In this situation, the opening 40 of base 12 is configured to be snugly received by crossbar 18. Seat 42 defined by collars 20 remains substantially circular even though opening 40 is reconfigured to match the cross section of crossbar 18. Thus, it can be understood that devices 10 and 110 may be used with crossbars 18 having square or triangular cross sections.

It should thus be evident that an anti-wrap device for a swing set made in accordance with the present invention provides a device capable of preventing a swing from being wrapped over the crossbar of a swing set. The device also accomplishes the objects of the invention without creating a protrusion that is a safety hazard. The anti-wrap device described herein thus accomplishes the objects of the present invention and otherwise substantially improves the art.

What is claimed is:

1. A device for preventing a swing from being wrapped over a crossbar of a swing set, the device comprising a base including first and second collars, each of said collars having a seat portion, a shoulder extending radially outwardly at one edge of each said seat portion, each of said collars having a body portion, said body portions having an angled wall extending downwardly from said shoulder, and further having at least one mounting hole, said base having a longitudinal opening configured such that said base may be fitted on the crossbar, and a sleeve rotatably carried by said base on said seat portions, whereby the swing may be connected to said sleeve.

2. In combination, a swing set having a swing carried by a crossbar, and a device for preventing said swing from being wrapped over said crossbar, said device including a base having first and second collars, each of said collars having a seat portion and a shoulder extending radially outwardly at one edge of said seat portion, said base having a longitudinal opening configured such that said base may be fitted on said crossbar, and a sleeve rotatably carried by said base on said seat portions, said swing being connected to said sleeve.

3. A combination according to claim 2 wherein each of said collars further includes a body portion, said body portion having an angled wall extending downwardly from said shoulder, said body portion further having at least one mounting hole.

4. A combination according to claim 3 wherein said body portion has a notch surrounding said mounting hole, said notch having a substantially planar floor surface.

5. A combination according to claim 2 wherein said collars are mounted on the crossbar with said seat portions abutting to form a seat, said seat being bordered by said shoulders.

6. A combination according to claim 2 further comprising a tab having a hole, said tab extending outwardly from said sleeve, and a bolt passing through said hole so that the swing may be connected to said sleeve.

7. A device for preventing a swing from being wrapped over a crossbar of a swing set, the device comprising a base including first and second collars, each of said collars having a seat portion, and a shoulder extending radially outwardly at one edge of said seat portion, said base having a longitudinal opening configured such that said base may be fitted on the crossbar, and a sleeve rotatably carried by said base on said seat portions, whereby the swing may be connected to said sleeve, wherein said sleeve has a channel that extends partially about said sleeve such that said sleeve is non-concentric with said base.

8. A device according to claim 7 wherein said channel defines a pair of shoulders on said sleeve.

9. A combination according to claim 2 wherein said base and said sleeve are split into longitudinal halves that may be retrofit over an existing swing set crossbar without disassembling the swing set.

10. A device for preventing a swing from being wrapped over a crossbar of a swing set, the device comprising a base including first and second collars, each of said collars having a seat portion and a shoulder extending radially outwardly at one edge of said seat portion, each of said collars having a longitudinal opening configured such that said base may be fitted on the crossbar, said collars being divided into joinable halves, and a sleeve rotatably carried by said base on said seat portions, the swing being connected to said sleeve, said sleeve being divided into joinable halves.

11. A device according to claim 10 further comprising at least one nut and bolt assembly, said nut and bolt assembly joining said joinable halves of said collars.

12. A device according to claim 11 wherein said nut and bolt assembly clamps said joinable halves of said collars on said crossbar.

13. A device according to claim 10 further comprising a nut and bolt assembly, said nut and bolt assembly connecting said joinable halves of said sleeve.

14. A device according to claim 10 further comprising a tab having a hole, said tab extending outwardly from said sleeve, and a bolt passing through said hole so that the swing may be connected to said sleeve.

15. A device according to claim 14 wherein said tab extends angularly from said sleeve.

16. A device according to claim 10 wherein, when said collars are mounted on the crossbar, said seat portions abut to form a seat, said seat being bordered by said shoulders.

* * * * *